US008087571B2

(12) United States Patent
Paulen

(10) Patent No.: US 8,087,571 B2
(45) Date of Patent: Jan. 3, 2012

(54) POURING PACKAGE AND POURING MEMBER FORMED FROM A WALL EXTENDING OVER AN OPENING

(75) Inventor: Thomas Gijsbert Paulen, Eindhoven (NL)

(73) Assignee: Weasy Pack International Ltd., Jalan Bahasa, Labuan (MY)

( * ) Notice: Subject to any disclaimer, the term of this patent is extended or adjusted under 35 U.S.C. 154(b) by 944 days.

(21) Appl. No.: 11/659,203

(22) PCT Filed: Jul. 14, 2005

(86) PCT No.: PCT/NL2005/000510

§ 371 (c)(1),
(2), (4) Date: Feb. 2, 2007

(87) PCT Pub. No.: WO2006/014102

PCT Pub. Date: Feb. 9, 2006

(65) Prior Publication Data

US 2008/0296300 A1 Dec. 4, 2008

(51) Int. Cl.
*B65D 5/74* (2006.01)
*B65D 17/44* (2006.01)

(52) U.S. Cl. ..... 229/125.04; 229/125.15; 229/125.16; 220/277; 220/278; 222/531; 222/566; 222/574

(58) Field of Classification Search ..... 220/278, 220/277, 266; 229/217–219, 125.04, 125.17, 229/125.15, 125.19, 125.21; 222/566, 574, 222/531, 572, 567

See application file for complete search history.

(56) References Cited

U.S. PATENT DOCUMENTS

| | | | | |
|---|---|---|---|---|
| 4,915,290 | A * | 4/1990 | Robichaud et al. | 229/125.08 |
| 4,934,590 | A * | 6/1990 | Robichaud et al. | 229/125.09 |
| 7,364,065 | B2 * | 4/2008 | Willemsen | 229/123.1 |
| 2004/0089165 | A1 * | 5/2004 | Seelhofer | 99/516 |

FOREIGN PATENT DOCUMENTS

| | | |
|---|---|---|
| FR | 2 753 174 | 3/1998 |
| WO | 03/045797 | 6/2003 |
| WO | 03/080454 | 10/2003 |
| WO | 2004/039684 | 5/2004 |

* cited by examiner

*Primary Examiner* — Robin Hylton
(74) *Attorney, Agent, or Firm* — Young & Thompson

(57) ABSTRACT

A pouring package for a fluid comprises a container (10) substantially impermeable to the fluid and having a pouring opening (11). The pouring opening is hermetically sealed by means of a breakable seal (30) in at least unopened state of the container. The container is provided with a pouring member (20) at the position of the pouring opening. Situated between a wall of the pouring member and the seal is a breaking member (21) which is awe and adapted to act on and break the seal when an external pressure is exerted on the wall.

19 Claims, 2 Drawing Sheets

POURING PACKAGE AND POURING MEMBER FORMED FROM A WALL EXTENDING OVER AN OPENING

BACKGROUND OF THE INVENTION

1. Field of the Invention

The present invention relates to a pouring package for a fluid comprising a container substantially impermeable to the fluid and having a pouring opening which in at least unopened state of the container is sealed by means of a breakable seal, wherein at least in ready-to-use situation the container is provided with a pouring member at the position of the pouring opening.

2. Description of the Related Art

Many types and sizes of pouring package exist and are applied on large scale as disposable packaging for holding (soft) drinks, juices, soups and other food products. In addition to liquids, these can also hold other fluids such as powders and grains. This is normally a so-called block pack which comprises a block-shaped container of the desired volume. The wall of the container is manufactured from cardboard and covered on an inner side with an impermeable plastic coating, while a desired printing is applied to the outside. This material is supplied as a semimanufacture and formed into the eventual package and filled with the desired content in a filling station.

In the course of time a number of embodiments have been proposed which should enable easy opening and optional resealing of the package. In its simplest form this involves a lip formed on the container which has to be folded outward so as to be cut off or opened in other manner. The thus outward folded lip forms a pouring member with which the content can be poured. A drawback of this closure is however that resealing is not possible, whereby the often perishable content is in open communication with ambient air for a longer period of time. For cutting or severing of the lip a tool such as a pair of scissors or a knife is also required, and this will not always be immediately available.

In order to obviate these drawbacks a number of proposals has been put into practice which provide at the position of the pouring opening a resealable pouring member which can be opened without a tool. A known example hereof is a plastic screw cap which engages on a screw thread formed on an outer wall of a cylindrical pouring member and, when closed, is sealed to the pouring member by means of a breakable plastic skirt. The seal is broken by unscrewing the cap and the cap can be unscrewed further to leave clear the pouring opening in the pouring member. After use the cap can be screwed on again to close the content of the package. Although such a cap is particularly practical in use, the opposite is the case in the production of the package. The screw cap closure must be arranged after the package has been filled, which, in addition to being a relatively difficult extra processing step, also requires an absolutely spotless, sterile environment where food products are generally concerned.

In order to obviate these drawbacks a number of proposals have been made for a pouring package, wherein the pouring opening is sealed by means of a first breakable closure, while a pouring member arranged at this position around the pouring opening is provided with a resealable second closure. The first breakable closure can be integrated beforehand in the material from which the container is formed, whereafter the package can be fully filled and can remain closed. The pouring member is then arranged on the package at the set position and provides the desired resealability with a resealable cover. Opening of the cover of the pouring member exposes the first closure, which must then be broken manually. This is sometimes a plastic lip which has to be pressed into the pack, which is however not very hygienic, and in other cases this is an aluminum foil which can be pulled away. The peeling force required for this purpose must remain relatively limited to avoid spillage, which makes heavy demands of the seal.

A drawback of these latter closures is that contact will inevitably occur between the fingers of the first user and the flow path along which the liquid will later flow out. This is undesirable from a hygienic viewpoint. A package which also solves this problem is described in the International patent application WO 02/32772 of applicant. The pouring package described therein comprises a container which is provided at the position of the pouring opening with a seal as first breakable closure. This seal lies wholly inside a special pouring member which is provided with means for breaking the seal from the outside, so that finger contact with the flow path can be avoided. These means for instance consist of an elongate strip which is connected to the seal and extends outside the pouring member. By exerting a tensile force on the strip the seal is broken and pulled outward together with the strip.

SUMMARY OF THE INVENTION

Although a practically ideal pouring package is hereby obtained, the practical usefulness stands or falls with the reliability of the means with which the seal can be broken from the outside. The present invention has for its object, among others, to provide a package of the type which provides this reliability.

In order to achieve the intended object a pouring package that has the feature according to the invention that there is present between a wall of the pouring member and the seal a breaking member which is able and adapted to act on and break the seal when an external pressure is exerted on the wall. In the pouring package according to the invention the breaking member is as it were pressed through the seal and lies enclosed between the wall of the pouring member and the seal. Because this mechanism does not depend on further manufacturing process factors and does not require any additional components, this results in an amazingly efficient and reliable breaking of the seal from outside, i.e. without having to come into contact with the flow path of the content of the package.

A preferred embodiment of the pouring package according to the invention herein has the feature that the breaking member is formed internally on the wall of the pouring member. The breaking member is thus arranged together with the pouring member, so that the part of the filling process prior thereto is not affected thereby. Particularly good experiences have been had in this respect with a further particular preferred embodiment of the pouring package according to the invention which is characterized in that the breaking member comprises a protruding spike.

To avoid an accidental action of the breaking member on the seal, for instance in mutually stacked position or during handling of filled pouring packages, a further preferred embodiment of the pouring package according to the invention has the feature that the pouring member has a first closed state and can be brought manually into a second, at least partly opened state, and that in the first state the pouring member at least substantially protects the breaking member from outside pressure. The protection by means of the pouring member thus prevents an unwanted action of the breaking member when a certain pressure is accidentally exerted on the pouring member. A further particular embodiment of the pouring package according to the invention is herein characterized in that in the second state the pouring member leaves clear a flow path from the pouring opening to outside the pouring member. In this case the second state not only releases the breaking member, but also forms a pouring state in which the package can be wholly or partially emptied after the seal has been broken.

It is found desirable in practice to distinguish a possibly opened package, i.e. a package of which the seal has been broken, from a certainly unopened package. In order to provide this, a further particular embodiment of the pouring package according to the invention has the feature that the pouring member is provided with indicator means which visually indicate in irreversible manner a transition from the first state to the second. A further particular embodiment has the more particular feature herein that the indicator means comprise a visible breakable closure arranged between the pouring member and the container. These embodiments are based on the insight that the pouring member must be in the second state for the purpose of breaking the seal. The indicator means indicate whether this state has ever been occupied in the package in question, so that if this is not the case, it can be assumed with a reasonable degree of certainty that the package is still unopened.

Particularly in the case of a content which is perishable it is desirable that a package which has been opened but is not empty can be sealed after use. In order to provide this a further preferred embodiment of the pouring package according to the invention has the feature that the pouring member can be resealed between the first and the second state.

In a further preferred embodiment, the pouring package according to the invention has the feature that the pouring member comprises a pouring spout which is connected to the container at the position of the pouring opening and extends further outside the container in the second, opened state than in the first, closed state. Such an extendable pouring spout facilitates pouring, particularly if this must take place into a glass or cup.

The extending of the pouring spout can be realized in many ways. It is thus possible for instance to pull out or slide out the pouring spout. A particular preferred embodiment of the pouring package has the feature however that the pouring spout can be folded out about a fold line. This simultaneously provides the desired resealability of the pouring spout, wherein the pouring spout is folded back airtightly into the folded state, and the described extendability for facilitating pouring. Such a pouring spout furthermore has a relatively simple structure and is thereby relatively easily to manufacture and arrange in practice. With a view to a predictable and reproducible fold, a further embodiment of the pouring package herein has the feature that a score line is arranged in a wall of the pouring spout at the position of the fold line. As a result of the score line the pouring spout will always fold at least almost at the same position.

In order to facilitate folding in and out of the pouring spout, a further preferred embodiment of the pouring package according to the invention has the feature that the pouring spout is resilient with a stable first and second state and an unstable transitional state therebetween. As well as by applying additional elements, such a resilience can also be achieved by a specific dimensioning and design of the pouring spout.

The same applies for the desired protection of the breaking member in the closed, first state of the pouring spout. In this respect a further preferred embodiment of the pouring package according to the invention has the feature that the pouring spout is attached with a first wall to the container all around the pouring opening, and is provided internally with the breaking member on a second opposite wall, that the second wall is relatively flexible at least at the position of the breaking member and that the first wall forms, at least beyond the fold line, a relatively hard shell which lies over the breaking member in the closed state of the pouring spout. In a more particular embodiment, the pouring package herein has the feature according to the invention that the pouring spout is formed integrally and that the first wall has a greater thickness than the second wall. By thus only making use of differing wall thicknesses the whole pouring spout can be manufactured in a single manufacturing step and integrally, which provides special advantages from an economic viewpoint.

The pouring member is advantageously formed in one processing step by means of an injection moulding process. With a view to a good release from a mould applied herein, a further particular embodiment of the pouring package according to the invention has the feature that the pouring member widens gradually over at least a part thereof toward a free end. The gradual widening moreover provides particularly good pouring properties.

Different types of seal can per se be applied over the pouring openings. Particularly good results have however been achieved using a particular embodiment of the pouring package according to the invention, characterized in that the seal comprises a substantially impermeable foil which is connected at least practically hermetically to an edge of the pouring opening. Because the seal is broken by means of pressure instead of pull, as in a known pouring package, no further demands are made here of the peeling strength, so that the seal can be wholly adapted to an effective action as a hermetic closure.

In a further particular embodiment, a pouring package according to the invention has the feature that the pouring member comprises a base part which is firmly connected to the container at the position of the pouring opening, and that the base part is able and adapted to receive a separate pouring part of the pouring member. In this case the pouring member is at least substantially arranged on the pouring opening only afterward by placing the pouring part in the base part, for instance by pressing or sliding. With a view to a mutual fixation the base part is provided for this purpose with receiving means which for instance comprise a snap opening or grooves into which the pouring member can be pressed or snapped respectively slide. This provides the advantage that the profile of the package can remain extremely flat at the position of the pouring opening, while the separate pouring part of the pouring member is supplied separately, optionally in a hygienic package. Furthermore, the pouring member can thus be designed and formed at least substantially separately in order to anticipate trends or to give form to promotional activities without this having to be taken into account during filling of the packages, which results in a logistical advantage as well as an advantage of scale.

BRIEF DESCRIPTION OF THE DRAWING FIGURES

The invention also relates to a pouring member for application on the pouring package according to the invention and will now be further elucidated on the basis of an exemplary embodiment and an associated drawing. In the drawing.

The figures are purely schematic and not drawn to scale. Some dimensions in particular may be exaggerated to a greater or lesser extent for the sake of clarity. Corresponding parts are designated as far as possible in the figures with the same reference numeral.

DETAILED DESCRIPTION OF THE INVENTION

Figure 1:
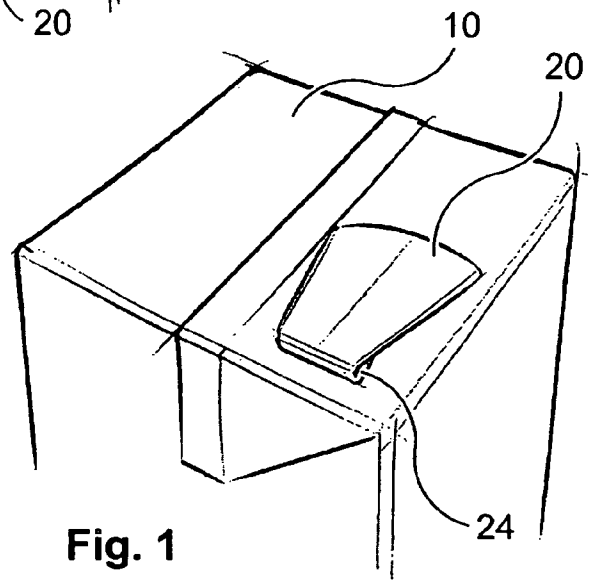
FIG. 1 shows in perspective an exemplary embodiment of a pouring package according to the invention in closed state.
Figure 4:
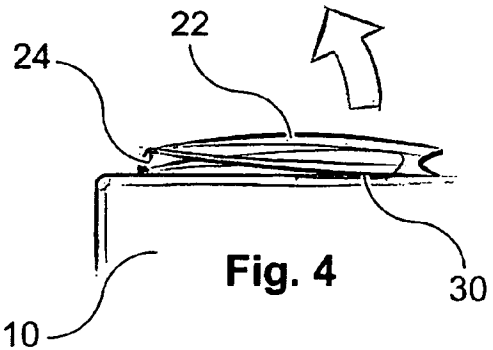
FIG. 4-6 shows in cross-section the pouring package of FIG. 1 in successive stages of use.

The pouring package shown in FIG. 1 comprises a block-shaped container 10 with a volume of about one to several litres. The container is suitable for containing liquids, such as (soft) drinks, fruit juices, dairy produce, soups, sauces and other pourable fluids, whether or not intended for consumption. In addition to food products, these can also be substances such as washing and cleaning products, non-synthetic oils and the like. The walls of the container are manufactured from plasticized cardboard which is covered on the inner side with a liquid-tight plastic coating, while a suitable printing has been arranged on an outer side. This material is supplied on a roll of blanks and formed into container 10 and filled with the relevant liquid in a filling station. On a top side is arranged a pouring opening 11, see also FIG. 3, which is concealed under a pouring member 20 which is arranged all around the pouring opening and is glued or otherwise adhered to the container. Pouring opening 11 is hermetically sealed using a suitable, breakable seal 30, which in this example comprises an aluminium foil strip 30 which is arranged over the pouring opening by being glued to the edge of the pouring opening, see also FIG. 4.

Figure 3:
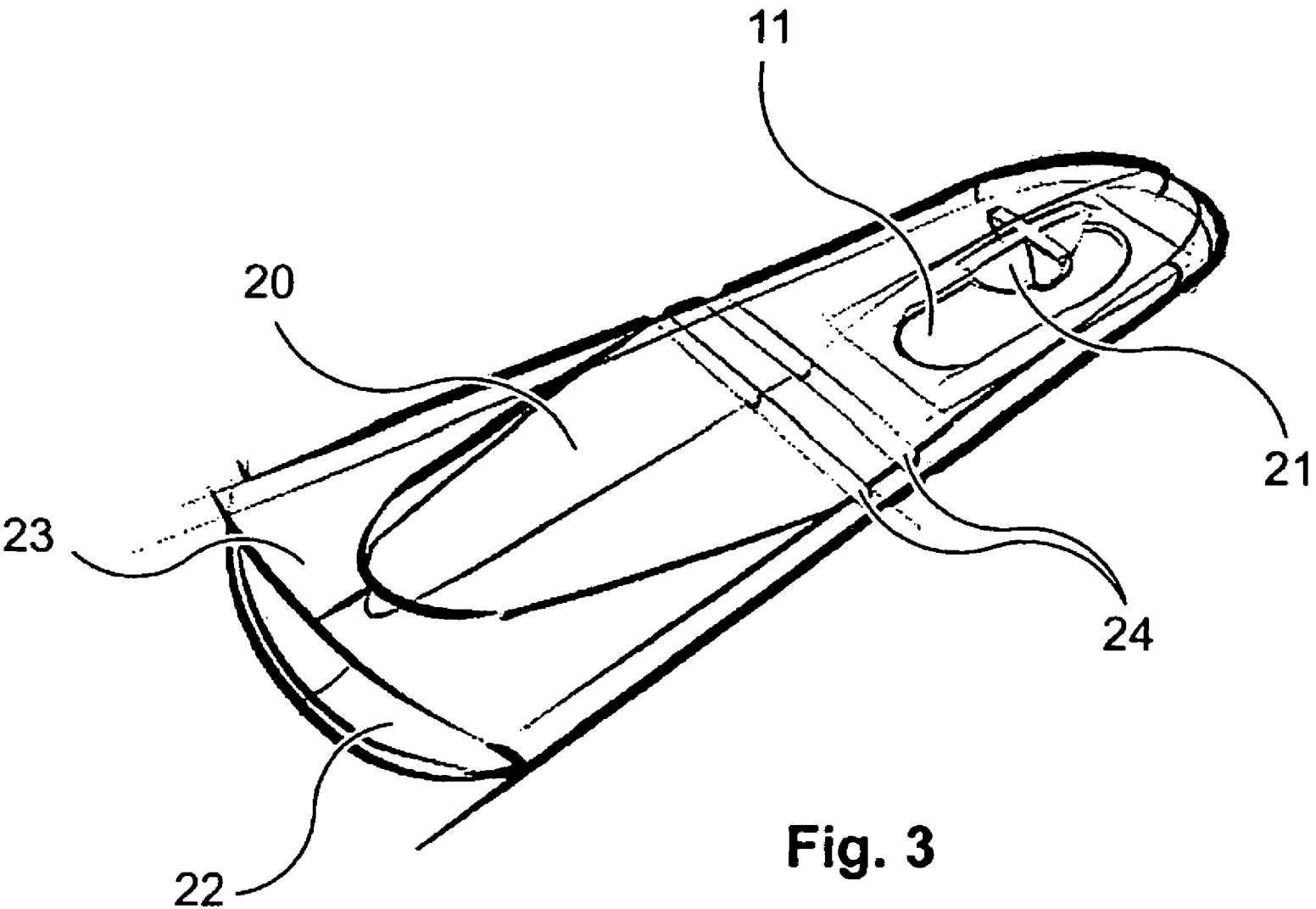
FIG. 3 shows an exemplary embodiment of a pouring member according to the invention, as applied on the pouring package of FIGS. 1 and 2.

The applied pouring member 20 is shown in more detail in FIG. 3. In this case the member comprises a pouring spout which is closed almost completely all around, but which leaves an opening at the position of pouring opening 11 in the package. Around this opening 11 the pouring spout provides a flange with which the pouring spout can be glued reliably to the edge of pouring opening 11 after the package has been filled and closed. The pouring spout is formed wholly from HD polyethylene or other suitable plastic and, if desired, provides space for a suitable printing, which can be arranged in relief or separately and which can also comprise, in addition to instructions for use, an advertising message or decoration.

Figure 2:
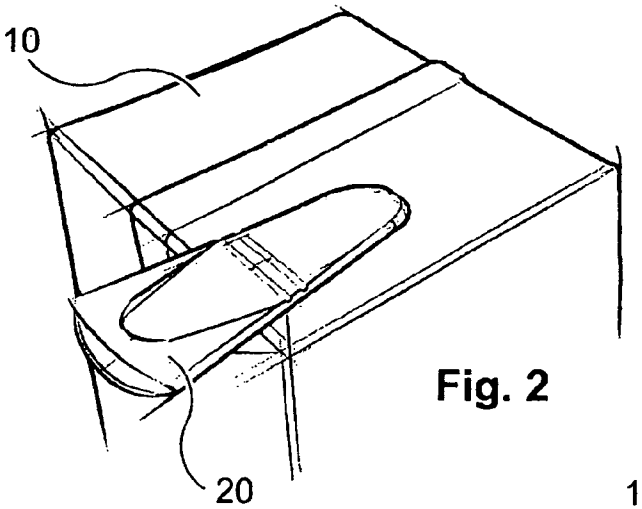
FIG. 2 shows the pouring package of FIG. 1 in opened, pouring state.

FIG. 1 shows the pouring spout in a closed state, wherein the pouring spout is folded shut around a fold line 24. Pouring spout 20 is maintained in this state by a breakable closure (not further shown) between an end of the pouring spout and package 10. The breakable closure can for instance comprise of being glued together, a seal or, as in this case, both. For opening the pouring spout 20 is moved manually from the closed first state shown in FIG. 1 to the folded-out state shown in FIGS. 2 and 5. The breakable closure between the pouring spout and the container is herein broken, which provides a visual indication of the integrity of the package.

The material and the wall thicknesses in pouring spout 20 are chosen such that the pouring spout has a certain resilience, whereby it whips automatically from the one state to the other. The pouring spout hereby has, as it were, two stable states which are shown respectively in FIGS. 1 and 2, and an unstable transitional state therebetween. Once it has been brought into the state of FIGS. 2 and 5, the content of the package can still not be poured since seal 30 in the pouring opening still prevents this.

Figure 5:
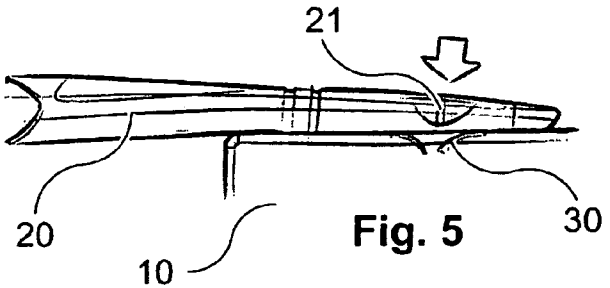
Figure 6:
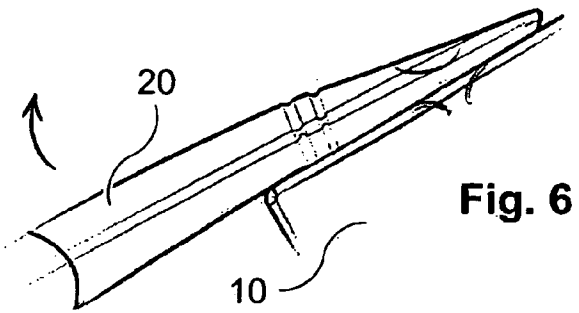

On order to break seal 30 the pouring package provides breaking member 21 which is situated between a wall 23 of the pouring member and seal 30. In this embodiment the breaking member is formed as an integral part on the inner wall of pouring spout 20 and comprises a relatively sharp spike. By manually exerting an effective pressure on wall 23 from the outside, spike 21 will act on seal 30 and eventually break it open. This is indicated in FIG. 5 by an arrow. The package is now ready for use, see FIG. 6. The pouring member now protrudes further outside package 10 than in the closed state and thereby spans at least partly the pouring distance to a glass or the like, which makes pouring markedly easier.

All in all, no additional tool is thus required to open the package, while a flow path of the fluid from the pouring opening to an outlet of the pouring member has remained covered the whole time and has not been touched, which enhances the storage life of often perishable products.

In order to prevent the possibility of seal 30 accidentally being broken too easily already in the first, closed state of pouring member 20, a second wall 22 of the pouring member is given a relatively thick and form-retaining form so as to provide as it were a shell in the closed state, which protects the breaking member from outside pressure. Conversely, the first wall 23 takes a thinner and thereby relatively flexible form for the purpose of transmitting a force exerted thereon almost directly to the breaking member.

After being used, the pouring member can be resealed by being folded shut and optionally adhered to the container. In order to allow this opening and (re)sealing to take place in reliable and controlled manner, two score lines are arranged in pouring member 20 which form fold lines at those locations. The pair of score lines provides for a practically tension-free folding of the pouring member which is also air-tight.

FIG. 3 shows clearly how the pouring spout widens toward an outer end thereof. This gradual widening enhances the release of the product from a mould in which it has been formed using an injection moulding process. This shape is moreover found to result in a particularly good pouring result.

Although the invention has been further elucidated above on the basis of only a single exemplary embodiment, it will be apparent that the invention is by no means limited thereto. On the contrary, many variations and embodiments are still possible for a person with ordinary skill in the art within the scope of the invention.

The invention is thus suitable not only for so-called block packs but for other forms of package, and not only for drinks but also for other liquids. In addition to being applied for larger packages, the invention can moreover be applied for portion packs. With a view to increased hygiene, the pouring member can be arranged on the package under a removable sealing which avoids contamination from the outside. The pouring member can be arranged directly onto the package or extend from a separate, particularly plastic part which is manufactured individually and forms at least a part of a wall of the package. This can particularly be a separate cover which is connected as such to the other part of the package in liquid-tight manner and already provided beforehand with the pouring member, in particular in that it forms an integral part thereof or is moulded thereon.

It is also possible for the package to be provided at the position of the pouring opening solely with a base part provided with receiving means in which the pouring member can be arranged afterward by the user, for instance by pressing or sliding it therein. In this case the pouring member itself can be supplied separately, whether or not in combination with the package, and herein placed, if desired, in a hygienic plastic foil packaging.

Instead of being a completely open, hollow body, the pouring member can also be provided internally with a membrane, a valve or other liquid barrier to avoid undesired spillage and dripping.

The invention generally provides a particularly practical pouring package which will satisfy both production engineering requirements and the wishes of the end-user.

The invention claimed is:

1. A pouring package for a fluid, comprising:

a container substantially impermeable to the fluid and having a pouring opening which in at least an unopened state of the container is sealed by a breakable seal, wherein at least in a ready-to-use situation the container is provided with a pouring member at a position of the pouring opening, and said pouring member comprises a wall which extends laterally over the pouring opening and completely covers said opening in both a closed and a ready-to-use state of the container; and a breaking member between said wall and said seal, said breaking member protruding from said wall which extends over said pouring opening, and said breaking member is positioned and adapted to act on and break said seal when a downward pressure is exerted externally on said wall of said pouring member at a side across from said seal.

2. The pouring package as claimed in claim 1, wherein the breaking member is formed internally on the wall of the pouring member.

3. The pouring package as claimed in claim 2, wherein the breaking member comprises a protruding spike.

4. The pouring package as claimed in claim 1, wherein the pouring member has a first closed state and can be brought manually into a second, at least partly opened state, and that in the first state the pouring member at least substantially protects the breaking member from outside pressure.

5. The pouring package as claimed in claim 4, wherein in the second state the pouring member leaves clear a flow path from the pouring opening to outside the pouring member.

6. The pouring package as claimed in claim 5, wherein the pouring member is provided with indicator means which visually indicate in irreversible manner a transition from the first state to the second.

7. The pouring package as claimed in claim 6, wherein the indicator means comprise a visible breakable closure arranged between the pouring member and the container.

8. The pouring package as claimed in claim 4, wherein the pouring member can be resealed between the first and second state.

9. The pouring package as claimed in claim 4, wherein the pouring member comprises a pouring spout which is connected to the container at the position of the pouring opening and extends further outside the container in the second, opened state than in the first, closed state.

10. The pouring package as claimed in claim 9, wherein the pouring spout can be folded out about a fold line.

11. The pouring package as claimed in claim 10, wherein a score line is arranged in a wall of the pouring spout at the position of the fold line.

12. The pouring package as claimed in claim 10, wherein the pouring spout is resilient with a stable first and second state and an unstable transitional state therebetween.

13. The pouring package as claimed in claim 10, wherein the pouring spout is attached with a first wall to the container all around the pouring opening, and is provided internally with the breaking member on a second opposite wall, that the second wall is relatively flexible at least at the position of the breaking member and that the first wall forms, at least beyond the fold line, a relatively hard shell which lies over the breaking member in the closed state of the pouring spout.

14. The pouring package as claimed in claim 13, wherein the pouring spout is formed integrally and that the first wall has a greater thickness than the second wall.

15. The pouring package as claimed in claim 1, wherein the pouring member widens gradually over at least a part thereof toward a free end.

16. The pouring package as claimed claim 1, wherein the seal comprises a substantially impermeable foil which is connected at least practically hermetically to an edge of the pouring opening.

17. The pouring package as claimed in claim 1, wherein the pouring member comprises a base part which is firmly connected to the container at the position of the pouring opening, and that the base part is able and adapted to receive a separate pouring part of the pouring member.

18. The pouring package as claimed in claim 1, wherein the pouring member is moulded onto a wall part of the container.

19. The pouring package as claimed in claim 1, wherein the pouring member comprises a liquid barrier.

* * * * *